United States Patent [19]

Peterson

[11] Patent Number: 4,934,709

[45] Date of Patent: Jun. 19, 1990

[54] MEMORY GAME APPARATUS AND METHOD OF PLAY

[76] Inventor: Kevin P. Peterson, 980—17th Ave. SE., Minneapolis, Minn. 55414

[21] Appl. No.: 300,578

[22] Filed: Jan. 23, 1989

[51] Int. Cl.[5] ..... A63F 3/00; A63F 9/18

[52] U.S. Cl. ..... 273/249; 273/272; 273/273

[58] Field of Search ..... 273/246, 243, 249, 272, 273/273

[56] References Cited

U.S. PATENT DOCUMENTS

| | | | |
|---|---|---|---|
| 1,797,742 | 3/1931 | Ward | 273/246 |
| 4,121,823 | 10/1978 | McBride | 273/249 |
| 4,201,388 | 5/1980 | Cantelon | 273/251 |

FOREIGN PATENT DOCUMENTS

| | | | |
|---|---|---|---|
| 1469067 | 3/1977 | United Kingdom | 273/243 |

*Primary Examiner*—Benjamin Layno
*Attorney, Agent, or Firm*—John W. Adams

[57] ABSTRACT

Educational game apparatus which includes a game board embodying player game paths in combination with a numbered die and test cards having information depicting diagramatically pictorial memorizing aides. These paths are in the form of concentric rings each having different lengths. The inner ring path being shorter and having a fewer number of spaces than the outer ring paths to provide means for handicapping the players. During a player's turn, the die is rolled to determine a basic number. Then a test card is drawn and the information on the card is conveyed as a question to the player to determine a bonus points number. Each question is divided into accumulative bonus segments. The number of spaces the player can move is determined by the basic number plus the total bonus points number, which is the number of correctly answered segments of the question.

3 Claims, 1 Drawing Sheet

MEMORY GAME APPARATUS AND METHOD OF PLAY

BACKGROUND OF THE INVENTION

Many educational games have been developed over the years. The present game provides an educational and training apparatus which specifically includes a testing program. Also a selectively handicapped game board whereby players with more knowledge will travel a longer game path than the players with less knowledge.

SUMMARY OF THE INVENTION

This competitive game which embodies the teaching of scriptural references. The players are rewarded for their scriptural knowledge. The game apparatus may include a game board having a plurality of game paths which are of different lengths. These paths can be in the form of rings one within the other so that the inner ring will be the shortest game path for players with the least biblical knowledge and the outer rings will be longer for players having greater biblical knowledge. The Game Apparatus includes, in addition to the different length game paths, a package of selected Bible references. Each reference includes a picture showing diagrammatically both the actual scriptural reference (book, chapter, and verse) and the wording of the verse, to assist the player in visually picturing the reference words.

Each player executes his turn by rolling a die to determine a basic number to be moved. The player on his left then draws a scripture card from the pile and reads the verse to the player. The player whose turn it is attempts to recite the correct scriptural reference and is given bonus points for the portions of the recitation that are correct. For example, one point might be allocated for the correct Testament, old or new; two points for the correct Book; three points for the correct chapter; and four points for the correct verse making a total of ten possible points. The point total is then added to the number on the die and the player advances that number of spaces along his game path.

There are a number of specific variations in the procedure for use at different times during the playing of each game. These all include the use of the same apparatus elements as are described previously above. The game proceeds until one of the players has crossed the finish line after the prescribed number of laps around his assigned game path, and the final review procedures are carried out.

DETAILED DESCRIPTION OF A PREFERRED EMBODIMENT

Figure 1:
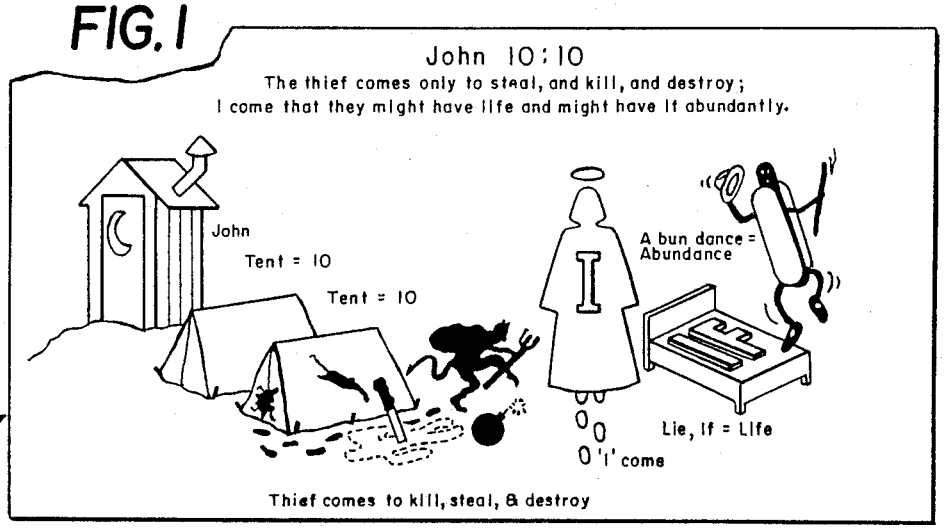
FIG. 1 is a top plan view of a selected pictorial scripture card.
Figure 3:
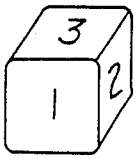
Figure 2:
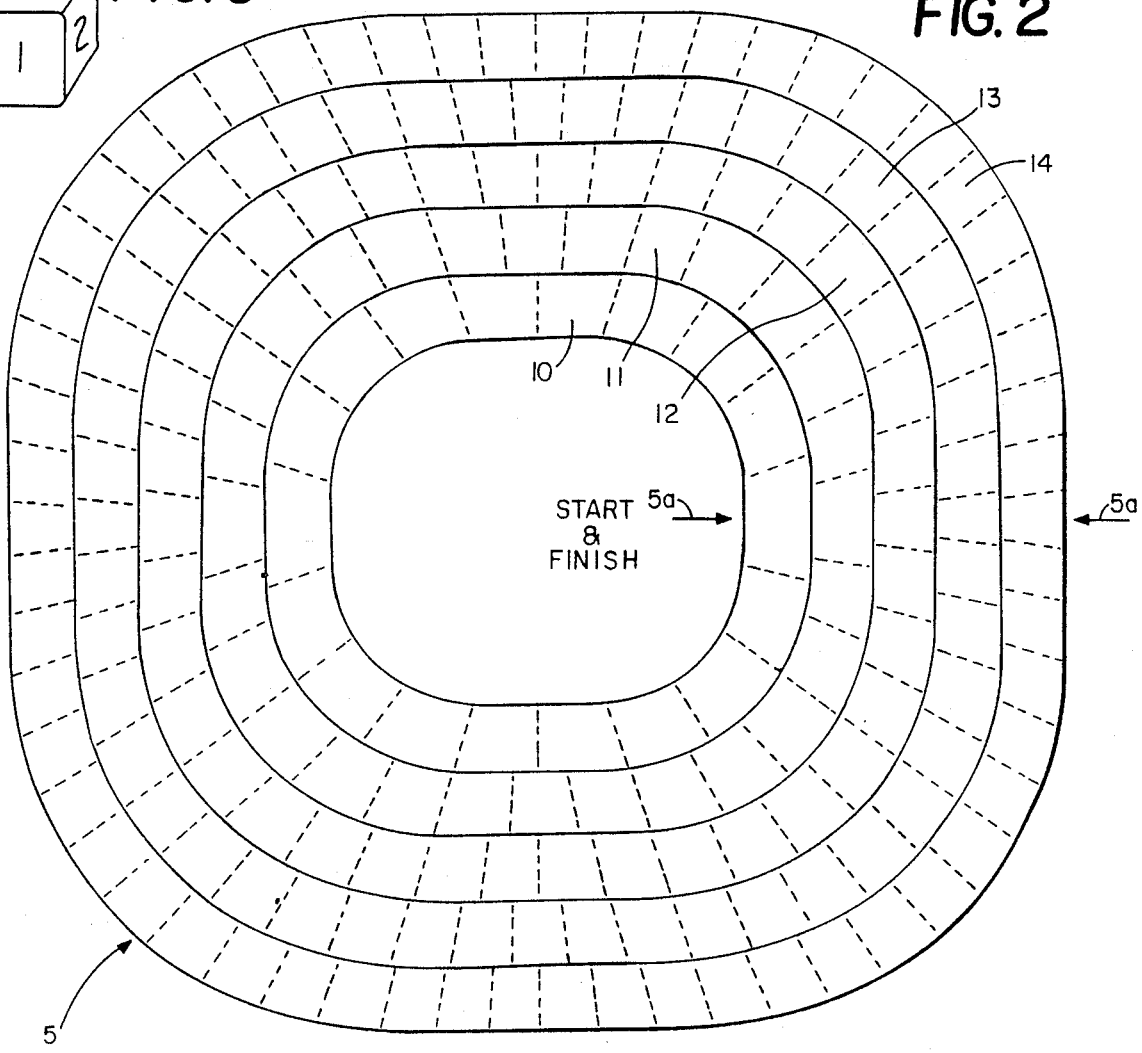
FIG. 2 is a top plan view of the game board.

A game board 5 is illustrated in FIG. 2 and embodies a plurality of game paths, such as the five game paths 10, 11, 12, 13, and 14 all having the same start and finish line 5*a*. These game paths have different lengths from the starting line to the finish line both indicated at 5*a* and may be arranged in rings on the board. The inner ring 10 being shorter than the outer rings in order to provide a basis for handicapping the players as will be described hereafter.

Each ring is divided into spaces and the differential number of spaces between the game path rings being the handicapping basis.

A plurality of verse cards 15 are also provided. Each card includes a written bible verse, its biblical reference, and a pictorial representation of both the verse and the reference in order to aid the player in memorizing both the verse and the reference.

The game is played by the players successively throwing a conventional die 20 having numbers 1–6 as shown. This determines the basic number to be moved. When a player throws the die, the testing player next to him will pull a scripture card 15 from the package of cards stored in a box for easy access and will read the scripture verse appearing on the card. The player participating in his or her turn will then respond by identifying the scripture verse by the Testament (old or new), the Book, then the Chapter, and the Verse. Each category will be assigned a number of bonus points for example, one point for the correct Testament; two points for the correct Book; three points for the correct Chapter; and four points for the correct Verse. The total bonus points accumulated by the player during his turn will be added up and added to the basic number on the die and the player then advances that number of spaces on his game path. The card is then kept by the reciting player for future reference as will be pointed out.

When one player crosses the finish line the final procedure is instituted. This final procedure includes selection by the testing player from the finishing player's cards and the finishing player is quizzed again to determine whether he has in fact memorized the scripture reference selected by the testing player on his left. If he fails to answer the question correctly, the player next to him is similarly quizzed and the first player to respond correctly to the selected card will be the winner regardless of the fact that another player crossed the finish line first.

If no one answers correctly after one round of final card selection, the card selection procedure is repeated from player to player and the first player to answer correctly wins the game. If all of the reference cards become exhausted without a correct answer, the player who first crossed the finish line will be declared the winner.

What is claimed is:

1. The method of playing a game comprising, providing a game board having a plurality of game paths thereon, each path having a number of spaces to determine the length thereof, providing means for determining a basic number for advancement of a player taking his turn, providing a plurality of test cards, respectively providing a specific test question to determine a bonus points number for the player participating in his turn, whereby the player's total spaces moved during each turn is determined by the basic number plus the bonus points number, the first player to cross his goal line at the end of his game path, will then be given the opportunity to recite on one of the game cards from which he has previously recited and if he is able to provide all of the correct answers from the game card he wins the game, if not, each player is given the same opportunity to recite on a former card and the first player to given correct the correct answer all the questions on the review card wins the game.

2. The method set forth in claim 1 and providing a pictorial representation on each card, depicting the answer to the test question to assist the player in memorizing the correct answer to said question for his final test recitation.

3. A board game apparatus comprising, a game board having a plurality of game paths thereon, each path having a number of spaces to determine the length thereof, means for determining a basic number for advancement of a player taking his turn, a plurality of test cards, respectively providing a specific test question to determine a bonus points number for the player participating in his turn, whereby the player's total spaces moved during each turn is determined by the basic number plus the bonus points number, each question being divided into a plurality of accumulative bonus segments for determining the total bonus points.

* * * * *